United States Patent [19]

Clarkson et al.

[11] 4,040,616

[45] Aug. 9, 1977

[54] SHEET TURN AROUND/INVERTER

[75] Inventors: Stanley G. Clarkson, Penfield, N.Y.; Joseph N. Muscarella, deceased, late of Albion, N.Y., by Ida M. Muscarella, administratrix

[73] Assignee: Xerox Corporation, Stamford, Conn.

[21] Appl. No.: 648,832

[22] Filed: Jan. 14, 1976

[51] Int. Cl.[2] ..... B65H 29/66

[52] U.S. Cl. ..... 271/65; 271/186; 271/DIG. 9

[58] Field of Search ..... 271/65, DIG. 9, 186

[56] References Cited

U.S. PATENT DOCUMENTS

| | | | |
|---|---|---|---|
| 2,901,246 | 8/1959 | Wagner | 271/65 X |
| 3,410,552 | 11/1968 | Collier | 271/65 |
| 3,700,231 | 10/1972 | Aasen | 271/65 X |

*Primary Examiner*—Richard A. Schacher
*Attorney, Agent, or Firm*—James J. Ralabate; Clarence A. Green; William A. Henry, II

[57] ABSTRACT

Copy from a processor is transported in a direction of travel on a conveyor toward a three position deflector, the first position of the deflector guides copy around one end of the conveyor to a sorter, in the second position the deflector intercepts the copy, deflects the leading edge of the copy in the opposite direction of travel and permits the trailing edge of the copy to become the leading edge and continue transportation as an inverted copy, in the third position the deflector is translated out of the path of copy flow completely.

26 Claims, 10 Drawing Figures

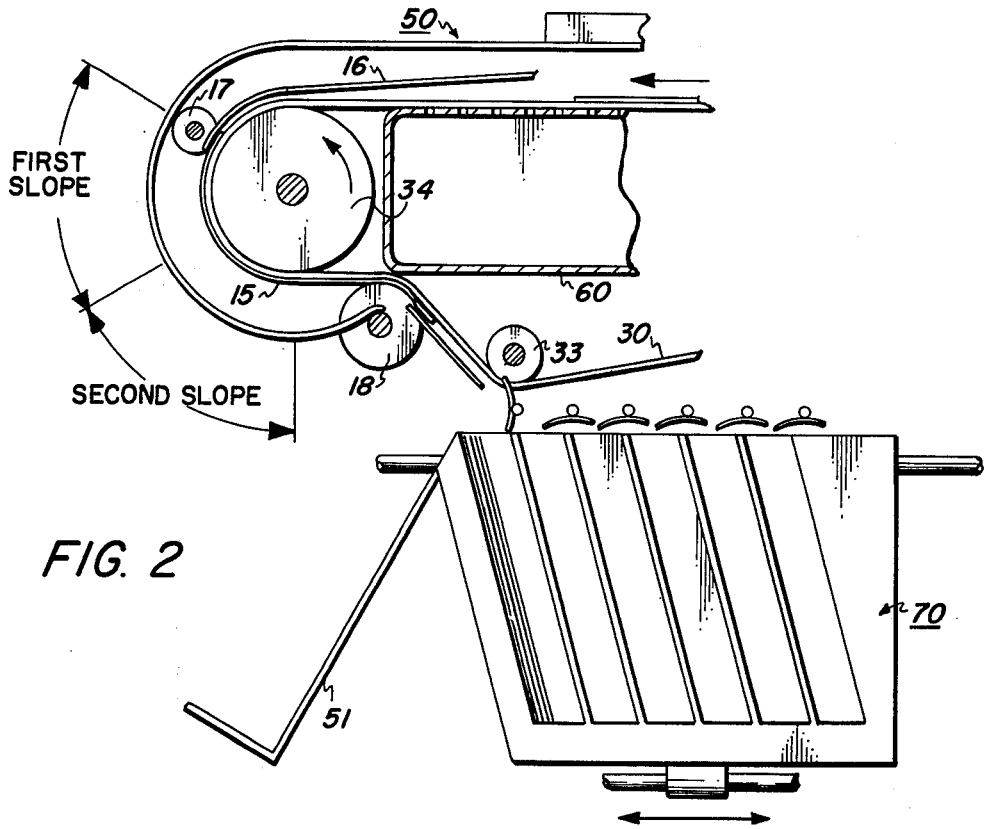
FIG. 2
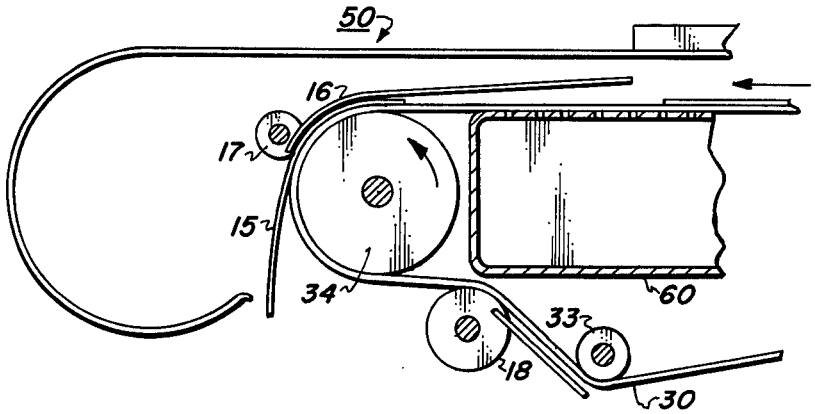
FIG. 3
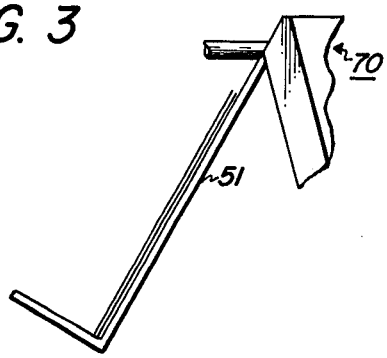

SHEET TURN AROUND/INVERTER

BACKGROUND OF THE INVENTION

This invention relates generally to material handling devices and more particularly to apparatus for inverting the facing position of a conveyed document.

In purpose, the invention is to provide a device for inverting sheet materials after one or both surfaces of the sheet have been affixed with images, indicia, designs, coatings etc. For example, in some printing operations it may be necessary to print upon one side of the sheet or record medium during a first run and on the opposite side of the record or sheet medium during a second run. Depending upon the types of feeding and stacking mechanisms being utilized, it may therefore be necessary to manually rearrange the order of the record prior to commencing a run to insure proper sequence. By eliminating this need for manually rearranging the sheets or documents one saves time and therefore reduce overhead.

From the standpoint of copying or reproducing machines, it is highly desirable at the end of a copying operation to have the originals and the copies stacked in a particular sequential order irrespective of the initial sequence of the originals. In most machines the order in which both originals and duplicates are delivered to the respective receiving station is wholly dependent upon the initial sequence of the originals. That is, if a stack of documents enter the machine in a particular order, the documents coming from the machine will be stacked in a particular order dependent upon the entering sequential order. It would, therefore, be advantageous to have a copying machine which supplied the originals or copies in a selected order independent of the order in which the originals entered the machine.

In many photocopiers and printing devices the several pages of a printed sequence are delivered from the printer onto a stack with the first page of the sequence face down at the top of the stack or face up at the bottom of the stack. Consecutive sheets are stacked in the same inverse order below or above the first page. Manual inversion of this stack per se will not correct the inverse orientation. Each sheet in the stack must be individually inverted to obtain proper consecutive orientation between the pages.

Various prior art devices have been devised to invert or reverse the position of articles advanced from supply sources. For example, U.S. Pat. No. 3,416,791 there is disclosed a document inverting apparatus that deflects a document into a receiving chute from its normal path of flow, leading edge first, and withdraws the document trailing edge first to transport an inverted sheet or document. In U.S. Pat. No. 3,523,687 an inverter device is shown that inverts by moving sheets or cards through a series of angular races by means of a drive roller. Other inverting apparatus includes U.S. Pat. Nos. 3,277,444; 3,556,512; 3,615,129; 3,700,231; 3,833,911; and 3,856,295.

SUMMARY OF THE INVENTION

It is an object of this invention to improve the inversion of materials.

It is a further object of this invention to improve the inversion of materials in a reproduction machine.

A further object is to achieve sheet inversion in a manner which minimizes the effects of sheet characteristics, such as curl and stiffness and increase reproduction speed.

These and other objects of the present invention are obtained by providing a sheet handling apparatus for selectively inverting sheets that comprises a conveyor which transports the sheets toward a biasing means adjacent to the conveyor. The conveyor is shaped so that the sheets are separated from the conveyor downstream from the biasing means. The sheets are urged back onto the conveyor by either a vacuum source or pinch rollers. Located adjacent the conveyor is a translatable deflector that is adapted to invert sheets before they are urged back onto the conveyor. The deflector intercepts the leading edges of the sheets as they leave the conveyor and deflects the leading edges in the opposite direction of travel. While the leading edges of the sheets are being deflected, the trailing edges of the sheets leave the biasing means and are caught by the pinch rollers and thus becomes the leading edges with the sheets now being transported inverted toward a sorter.

For a better understanding of the invention as well as other objects and further features thereof, reference is had to the following detailed description of the embodiments of the invention to be read in connection with the drawings wherein:

BRIEF DESCRIPTION OF THE DRAWINGS

FIG. 2 is a schematic of a portion of the system of FIG. 1 showing the turn around/inverter of the present invention in a first position to deflect a sheet into the sorter;

FIG. 3 is a partial schematic of the turn around/inverter in a second position to allow single sided copy to pass directly to a repository;

DETAILED DESCRIPTION OF THE PREFERRED EMBODIMENTS

Figure 1:
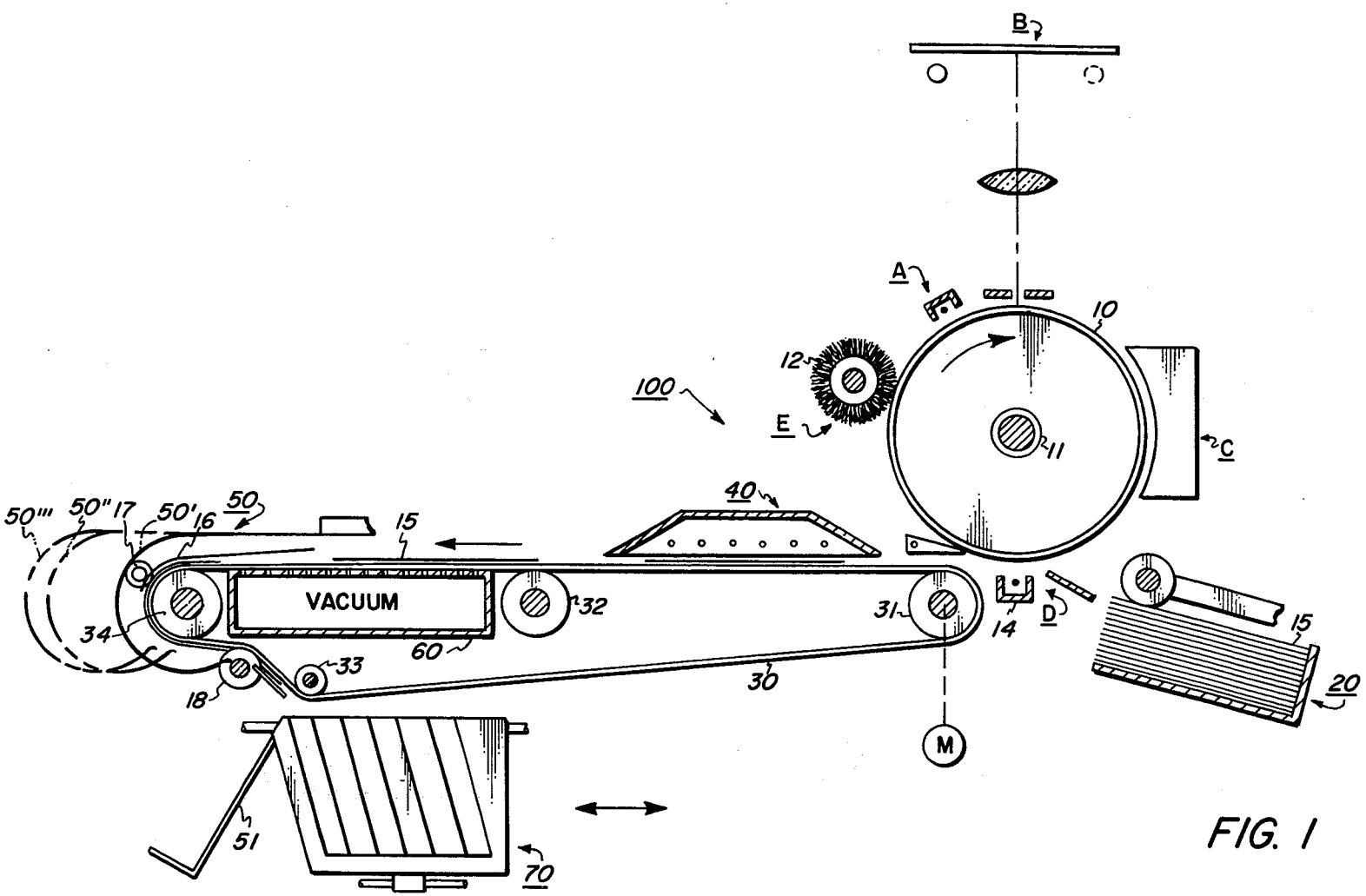
FIG. 1 is a schematic of an automatic reproducing machine with a sorter employing the turn around/inverter apparatus of the present invention.

There is illustrated schematically in FIG. 1 an exemplary continuous xerographic apparatus containing an embodiment of the sheet or document turn around/inverter of this invention comprising a selective inverting means including a guide member having a surface for guiding a sheet as it is received from a conveyor or transport with the guide member being arranged for movement between a first position wherein a lead edge of the sheet as it is received from the transport is intercepted and guided along said surface in a first direction and a second position wherein the lead edge of the sheet as it is received from the transport is intercepted and guided along the same surface in a second direction generally opposed from the first direction to invert the sheet.

It should be understood at the outset that this invention is capable of use in machine systems that produce simplex and/or duplex copy and include sorting or collating therein. Also, the inverter can be used in any type of reproducing device regardless of the process used. It can be used anywhere that members are to be inserted.

FIG. 1 shows a recording system that comprises an imaging plate including a photoconductive layer or light receiving surface placed on a conductive backing and formed in the shape of a drum, generally designated by the number 10, which is mounted upon a shaft 11 journalled to the frame (not shown) to rotate in the direction indicated by the arrow to cause the drum to pass sequentially through a plurality of xerographic processing stations. Drum 10 is rotated at a constant rate through the drive action of a synchronous motor (not shown).

For the purposes of the present disclosure, the several xerographic processing stations in the path of movement of the drum surface may be described as follows:

A charging station A, at which a uniform electrostatic charge is deposited on the photoconductive layer of the drum surface by means of a corona discharge device 13.

An exposure station B, at which a light or radiation pattern of an original to be reproduced is projected onto the drum surface to dissipate the charge found thereon in the exposed areas thereby forming a latent electrostatic image thereon, the exposure station being positioned adjacent to the charging station in the direction of drum travel;

A development station C, at which a xerographic developing material including toner particles having an electrostatic charge opposite to the electrostatic latent image charge are brought into contact with the image bearing drum surface whereby the toner particles adhere to the electrostatic latent image in configuration to the original to be reproduced thereby making the latent image visible;

A transfer station D, at which the xerographic powder image is electrostatically transferred from the drum surface to a final support material 15 by means of a second corona generating device 14 similar to that used in the charging station;

A cleaning station E, at which the drum surface is brushed by means of a rotating cylinder brush 12 to remove residual toner particles remaining thereon after image transfer.

In the present embodiment, the final support material or sheets 15 are located in hopper 20 and are fed from the hopper or supply 20 by conventional feed means to the transfer station D. From the transfer station the sheets are transported or moved by conveyor or transport means 30 through a fuser 40 wherein the developed and transferred powder image on the sheet is permanently affixed thereto.

It is felt that the above description of the xerographic process is sufficient for purposes of the present application. For a more detailed explanation of the copier/duplicator xerographic components, reference is made to U.S. Pat. No. 3,645,615 entitled "Copying Apparatus".

As will be described in more detail below, the preferred inverter apparatus of the present invention includes a horizontal transport or conveyor 30 that conveys sheets toward a deflector 50 that can be crescent shaped and is translatable to three different positions. The deflector can be made from any suitable material such as sheet metal stamped into bent straps, wire or flexible stainless steel. If one desired to make the deflector of flexible stainless steel, a wide variety of paper stock could be accomodated. For example, 16 pound paper could be used without an appreciable bending of the deflector, however, with 120 pound card stock, the deflector would bend according to the beam strength of cards and still function as desired, i.e., the beam strength of the paper would determine the shape of the flexible deflector. In the first position 50', the deflector receives the sheets and directs them toward a sorter or collator. In a second position 50'', the deflector which has a first slope and a second slope relative to the leading edge portion of the sheets or substrates, receives the lead edges of the sheets from the conveyor in the second slope and guides or deflects them along the surface of said deflector away from the conveyor so that the trailing edges of the sheets are turned over and can be urged back onto the conveyor to thereby transport inverted sheets. The first slope of the deflector deflects or bends the leading edges of the sheets or substrates toward the conveyor so that the leading edges of the sheets become the available edges to be first urged back onto the conveyor. In the third position 50'' the deflector or guide member is completely removed from the path of the sheets to allow passage of the sheets to a tray 51 by gravity. As can be seen in FIG. 2, the first and second slopes of deflector 50 serve to either bend the leading edges of the sheets around the edge of conveyor 30 or bend them in the opposite direction of travel for inversion.

The sheets as they are transported on the belt-type conveyor by a plurality of belts having apertures therein are held thereon by an urging means 60 such as a vacuum chamber. The conveyor is located on adjacent rollers 31, 32, 33 and 34 with roller 31 being the drive roller that is driven by a motor M (not shown) and rollers 32, 33 and 34 being idler rollers. A curved direction member 16 is located at the remote end of the conveyor that has an upper and under side for directing the sheets around the end of the conveyor toward biasing means 17 which is adjacent to the conveyor means and is adjusted to bias sheets against the conveyor. Since the conveyor is curvalinear shaped, sheets separate from the conveyor downstream from the biasing means due to the beam strength of the sheets and gravity. Upon separation from the conveyor, the leading edges of the sheets are directed toward three-position selectively deflecting deflector 50 to be either intercepted and directed toward a sorter 70 by way of pinch roller 18, intercepted and inverted while being directed toward the sorter, or not intercepted at all and allowed to fall due to gravity directly to a catch tray or repository. The three positions of the deflector are controlled by a selector switch (not shown) on the face of the copier or processor. The selector switch is connected through suitable electrical circuitry so that when it is pushed to actuate motor 56 in FIG. 5, the deflector 50 is moved to the left as viewed in FIG. 1 to either position 50', 50'' or 50''' by advancing along screw 55 according to the selection made.

Figure 4:
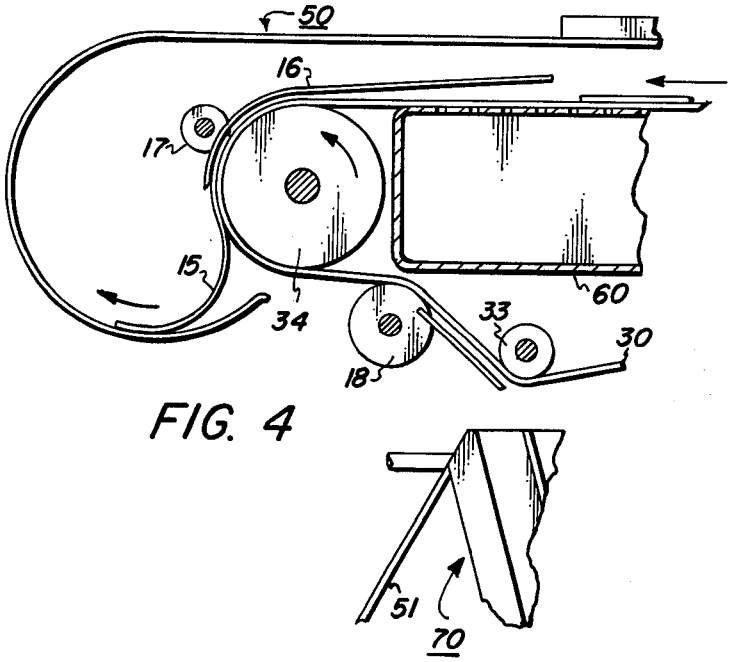
FIGS. 4—4C are partial schematics of the turn around/inverter in a sequence of four positions as a sheet is inverted.
Figure 4A:
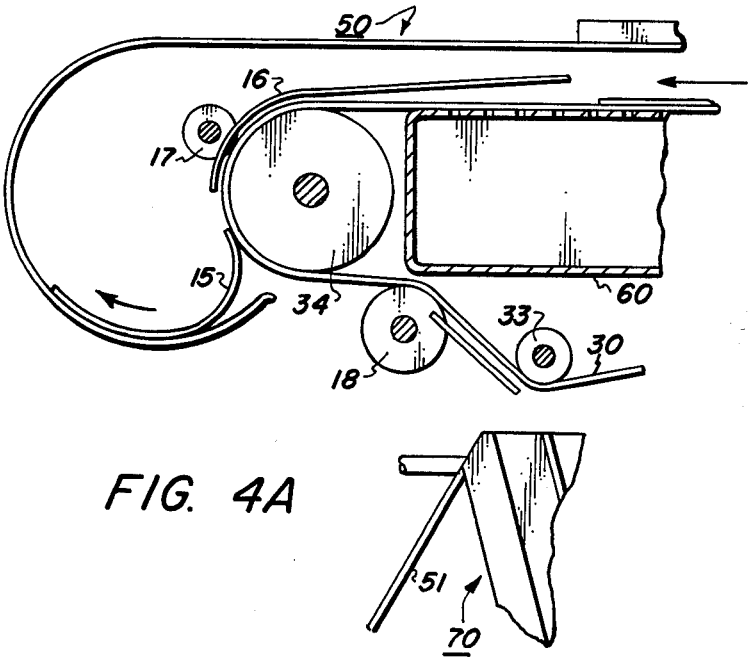
Figure 4B:
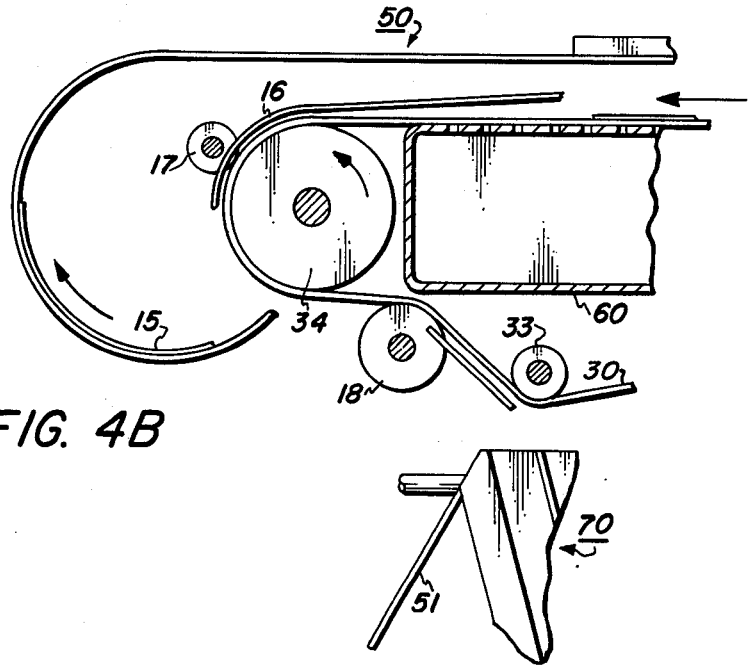
Figure 4C:
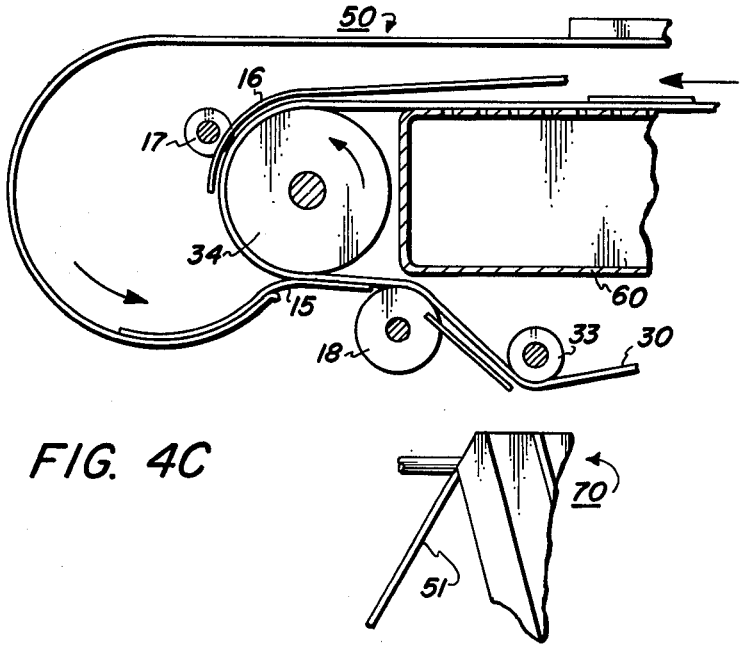

In reference to FIG. 2 there is shown a partial schematic of the sheet turn around/inverter of the present invention in the first selective position wherein the leading edges of sheets that are arcuately deformed on and separated from the conveyor downstream of the biasing means and are arcuately deflected by the curved or arcuate shaped deflector back onto the underside of conveyor 30 where they are caught and held to the conveyor by vacuum 60 through perforations in the belts of the conveyor or by pressure rollers such as pinch roller 18. The leading edge of sheet 15 referred to herein is the edge closest to deflector 50 and the trailing edge is the edge furthest removed from the deflector as the sheet is conveyed on conveyor 30. A conventional sorter or collator 70 having gates for channeling sheets to individual trays collects the sheets from the underside of the conveyor for sorting. In the second selective position in reference to FIGS. 4—4C, the sheets 15 that are transported and arcuately deformed in a first direction on the conveyor are shown in FIG. 4 being separated from the conveyor by the biasing means 17 downstream from the biasing means with moveable deflector 50 intercepting the separated leading edges of the sheets that have first sides adjacent the conveyor and second sides removed from the conveyor when the leading edges of the sheets are below the trailing edges and bending or deforming as well as rotating them in a second direction opposite to the first direction to a degree such that the sheets are momentarily stored as the trailing edges thereof leaves the biasing means. However, once the trailing edges of the sheets leaves the biasing means they are below the leading edges of the sheets and become the first available edges to be deflected back onto the underside of conveyor 30 and thereby are transported as inverted sheets. FIG. 4A shows sheet 15 just as the trailing edge leaves biasing roller 17 with the sheet continuing to be rotated and deformed in a direction opposite its original direction of travel within deflector 50 but now the rotation is caused by the weight of the sheet and gravity in addition to the force applied to the trailing edge of the sheet by biasing roller 17. In FIG. 4B the sheet is shown completely released from biasing roller 17 and traveling in a clockwise direction within deflector 50 due to the beam strength of the paper, and the curvature of the deflector as well as gravity. FIG. 4C shows the sheet continuing rotation in a counter clockwise direction within deflector 50 with the trailing edge of the sheet becoming the leading edge thereof resulting in the sheet now being transported toward sorter 70 in inverted form. If the third position is selected as depicted in FIG. 3 the guide or deflector 50 is translated completely out of the path of the sheets as they are separated from the conveyor by the biasing means and thereby allow the sheets to be directed by gravity into catch tray or depository 51.

Figure 5:
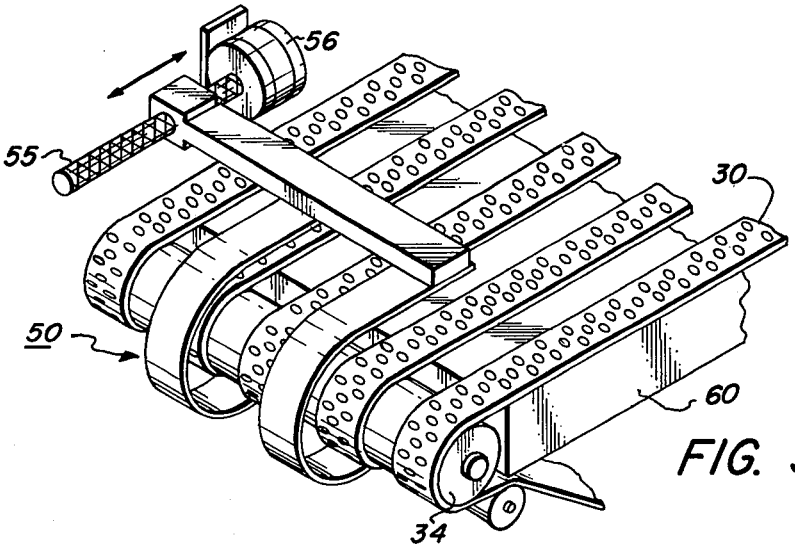
FIG. 5 is a partial perspective of the turn around/inverter and conveyor of this invention.
Figure 6:
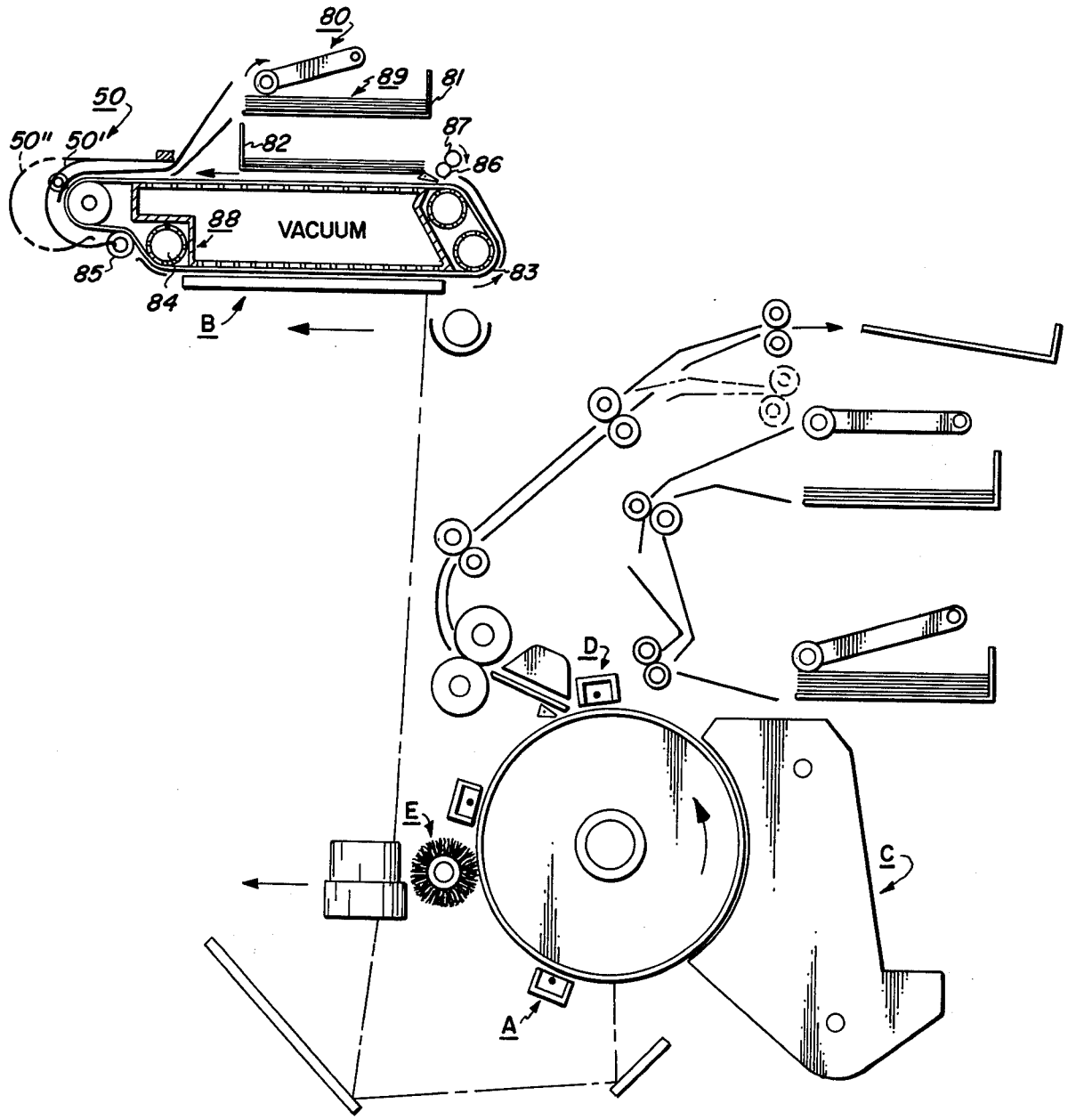
FIG. 6 is an alternative embodiment of the present invention.

In reference to FIG. 5, the means for controlling the position of deflector member 50 relative to conveyor 30 is shown as screw 55 and drive member or motor 56 and is actuatable for driving the deflector to any of three positions by a selector switch on the panel of processor 100. An alternative embodiment of this invention is shown in FIG. 6 where the sheet turn around/inverter is located between automatic document handling system 80 and exposure station B. In most duplexing machines, documents to be duplexed are copied on one side, turned over by hand either one at a time or in a stack and subsequently copied again. To speed up this process as well as remove the possibility of human error, this embodiment employs an automatic document handling system. Documents 89 are fed from hopper 81 to conveyor feeder 83 toward deflector 50. The deflector on the first pass of a document simply directs the document around the end of conveyor 83 toward pinch roll 85 and one of three vacuum capstans 84. After the document passes vacuum capstan 84, it is passed over exposure station B by use of vacuum restraining means 88. Once exposure is completed, the document is transported by conveyor 83 and capstans 84 toward catch tray 82. If the selector switch located on the face of the machine (not shown) has been actuated for only one pass of the document, stripper finger 86 is actuated to flip down and the document is propelled through guide rollers 87 to catch tray 82. However, if the selector switch is actuated for copying both sides of document 89, stripper finger 86 will remain up and allow the document to pass thereunder and continue being transported by transport 83 toward deflector 50 a second time. In this mode, deflector 50 has been translated to position 50″ and as the document is intercepted by the deflector on this second pass the document is inverted as explained in reference to FIG. 4–4C. After inversion, the document is passed over exposure station B a second time and continued in transportation to repository 82. Components marked the same in this figure as in FIG. 1 perform the function in the same manner. For a more detailed discussion of the xerographic apparatus shown in FIG. 6, reference is made to U.S. Pat. No. 3,833,911.

Figure 7:
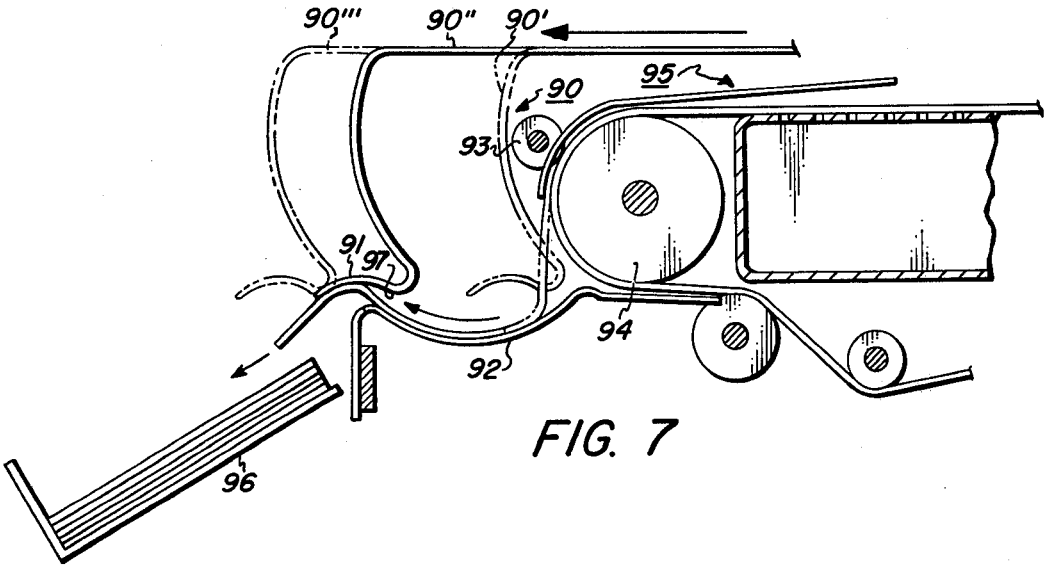
FIG. 7 is a schematic view of an alternative embodiment of the turn around/inverter in two part form.

FIG. 7 shows an alternative embodiment 90 of the sheet turn around/inverter of the present invention in two part form. The moveable or translatable upper portion 91 cooperates with a lower fixed portion thereof 92 to selectively direct substrates or sheets from either of three different positions. In the first position, 90′ the moveable part of the deflector 90 directs sheets that are transported on conveyor 95 past biasing means 93 around drive roller 94 to a conventional sorter. In position 90″ the deflector directs sheets to a catch tray 96 since the sheets as they are leaving biasing means 93 contact the inner surface of stationary deflector portion or means 92 and are deflected so as to contact a first inner surface 97 of the moveable deflector to be deflected thereby to catch tray 96. In position 90‴, sheets as they are transported past biasing means 93 contact the inner surface of fixed deflector portion 92 and are deformed along the inner surface thereof toward moveable deflector member or means 91. As the sheets move along a second inner surface 98 of the moveable deflector after they have completely left biasing means 93, due to the beam strength of the sheets as well as the curvature of surface 98, the sheets are momentarily stored and are then urged thereby in addition to gravity in the reverse direction along the inner surface of stationary deflector means 92 toward the crimped area 99 of means 92 to be deflected into conveyor 95 for continued transportation, thereby in inverted form.

Although the invention has been described with reference to a preferred embodiment, it is to be understood that this embodiment is merely illustrative of the principles of the invention. For example, the turn around/inverter of this invention could be used with a document handling system that feeds originals to an exposure station. Thus, it is to be understood that numerous modifications may be made in the illustrative embodiment of the invention and other arrangements may be demised without departing from the spirit and scope of the invention.

What is claimed is:

1. A sheet handling apparatus for selectively inverting sheets comprising:

conveying means adapted to convey sheets, biasing means adjacent to the conveying means adapted to bias sheets against said conveying means, the conveying means conveying the sheets past the biasing means with a leading edge and a trailing edge, said conveying means being shaped so that the leading edge of the sheet separates from the conveyor downstream of the biasing means, urging means to urge a selected available edge of the sheet back onto the conveyor means after it has been separated from the conveyor means downstream of the biasing means, movable deflector means to selectively invert the sheet, said deflector means having a first slope and a second slope relative to the leading edge portion of the sheet, said second slope deflecting the leading edge of the sheet away from the conveying means so that the trailing edge of the sheet becomes the available edge to be first urged back to the conveying means, and said first slope deflecting the leading edge of the sheet toward the conveying means to that the leading edge of the sheet becomes the available edge to be first urged back to the conveyor means, and selector means to select either the first or second slope to act on the leading edge of the sheet whereby the sheet is inverted before being placed on the conveyor means only when the first slope is selected to deflect the leading edge of the sheet as the sheet passes beyond the biasing means.

2. The sheet handling apparatus of claim 1 wherein said conveying means is in the form of a belt drive with a vacuum chamber therein which pulls a workpiece to the belt.

3. The apparatus of claim 1 wherein said deflector means includes means for curving the sheet during sheet inversion operation.

4. The apparatus of claim 1 wherein said deflector means includes means for semi-circularly deforming the sheet during sheet inversion operation.

5. The apparatus of claim 1 wherein said deflector means includes two guide portions.

6. The apparatus of claim 5 wherein at least one of said guide portions is moveable.

7. The apparatus of claim 6 wherein at least one of said portions is crescent-shaped.

8. The apparatus of claim 1 wherein said apparatus is a document inverting system for copying both sides of a document.

9. The apparatus of claim 1 wherein said deflector means includes means for semi-circularly deforming the sheet during inversion operation, said means for semi-circularly deforming the sheet comprising two guide portions, said guide portions including at least one moveable portion and at least one crescent-shaped portion.

10. In a reproduction system having an imaging processor which forms images on a copy substrate, a sorter which collates copies formed by the imaging processor, a conveying means to bring the copy substrate from the processor to the sorter and a substrate inversion apparatus adapted to selectively invert substrates before they reach the sorter, the improvement comprising:

biasing means adjacent the conveying means between the processor and sorter adapted to bias substrates against the conveying means, the conveying means conveying the substrate past the biasing means with a leading edge and a trailing edge, said conveying means being shaped so that the leading edge of the substrate separates from the conveyor downstream of the biasing means, urging means to urge a selected available edge of the substrate back onto the conveyor means after it has been separated from the conveyor means downstream of the biasing means before it reaches the sorter, movable deflector means adapted to invert the substrate, the deflector means having a first slope and a second slope relative to the leading edge portion of the substrate, said first slope deflecting the leading edge of the substrate away from the conveying means so that the trailing edge of the substrate becomes the available edge to be first urged back to the conveying means, and said second slope deflecting the leading edge of the substrate toward the conveying means so that the leading edge of the substrate becomes the available edge to be first urged back to the conveyor means, and selector means to select either the first or second slope to act on the leading edge of the substrate whereby the substrate is inverted before it reaches the sorter only when the second slope is selected to deflect the leading edge of the substrate as the substrate passes beyond the biasing means.

11. The improvement of claim 10 wherein said sorter has gates for channeling sheets to individual trays.

12. In a reproduction system having an image processor which forms images on a copy substrate, document handling apparatus including a conveying means to feed original documents to be reproduced from a supply of original documents to an exposure station one at a time, and an original document inversion apparatus between said feeding means and the exposure station to selectively invert original documents before they reach the exposure station, the improvement comprising:

biasing means adjacent the conveying means adapted to urge original documents against said conveying means, said conveying means being shaped so that the original documents separate from the conveyor downstream of the biasing means;

urging means to urge the original documents back onto the conveyor means after they have been separated from the conveyor means downstream of the conveyor means and upstream of the exposure station, translatable deflector means adjacent the conveyor means adapted to invert original documents before they are urged back onto the conveyor by the urging means, said deflector means being translatable between a first position where the original documents are not inverted and a second position where the original documents are inverted; and selector means to translate the deflector means to the second position so that inversion of original documents are accomplished and to translate the deflector means to a first position so that the original documents are not inverted.

13. In a sheet transporting apparatus having means for transporting a sheet in a given direction to a desired position and a means for receiving a sheet from the transport at said position and for selectively inverting the sheet, the improvement wherein said selective inverting means includes a guide member having a surface for guiding the sheet as it is received from said transport, said guide member being arranged for movement between a first position wherein a lead edge of said sheet as it is received from said transport is intercepted and guided along said surface in a first direction and a second position wherein said lead edge of said sheet as it is received from said transport is intercepted and guided along the same surface in a second direction generally opposed from said first direction to invert the sheet.

14. The improvement of claim 13 including a third position for movement of said guide member wherein the lead edge of said sheet is allowed to travel past said guide member free from interception by said guide member.

15. The improvement of claim 14 including selector means for moving said guide member to said third position.

16. The improvement of claim 13 wherein said guide member is of curved configuration.

17. The improvement of claim 16 wherein said guide member is crescent-shaped.

18. The improvement of claim 13 including selector means for moving said guide member between said first and second positions.

19. The improvement of claim 13 wherein said guide member is in two portions.

20. The improvement of claim 13 wherein said guide member includes a moveable portion and a fixed portion.

21. A sheet handling apparatus for selectively inverting sheets comprising:

conveying means adapted to convey sheets, biasing means adjacent said conveying means adapted to bias sheets against the conveying means, said conveying means being shaped so that the sheets are separated from the conveyor downstream of the biasing means, urging means to urge the sheets back onto the conveyor means after they have been separated from the conveyor means downstream of the biasing means, translatable deflector means adjacent the conveyor means adapted to invert sheets before they are urged back onto the conveyor by the conveyor means, said deflector means adapted to translate between a first position where the sheets are not inverted and a second position where the sheet is inverted, and wherein said translatable deflector means is of curved configuration and adapted in relation to said bias means to receive lead edges of sheets to be inverted from one side of said conveying means and by guiding said lead edges in an opposite direction allows the opposite side of said conveying means to catch the trailing edges of said sheets and thereby transport inverted sheets, and selector means to translate the deflection means to the second position so that inversion of sheets is accomplished and to translate the deflector means to the first position so that the sheets are not inverted.

22. In a xerographic reproduction machine of the type having a photoconductive member, means to create a latent electrostatic image on the member, developing means to bring transferably toner particles into contact with the member to create a transferable toner image from the member to a copy sheet, a copy sheet supply station and a sorter sheet receiving station, the improvement comprising:

transport means for transporting sheets from said xerographic reproduction machine, biasing means adjacent to the transport means adapted to bias sheets against said transport means, the transport means transporting the sheets past the biasing means with a leading edge and trailing edge, said transport means being shaped so that the leading edge of the sheets separate from the transport means downstream of the biasing means, urging means to urge selected available edges of the sheets back onto the transport means after they have been separated from the transport means downstream of the biasing means, and deflector means adapted to translate between three positions whereby in the first position sheets are deflected by the deflector means as they separate from the urging means into a sorter, in the second position the leading edge of the sheets are received by the deflector means directed in travel in the opposite direction whereupon the trailing edges of the sheets are caught by the urging means in order to transport an inverted copy, and in the third position sheets travel through the biasing means to a catch tray with the deflector being completely removed from the sheet path.

23. A method of selectively inverting a sheet comprising the steps of:

a. moving the lead edge of the sheet on a conveyor toward a deflector member in a first direction, b. positioning said deflector to intercept the sheet, c. intercepting the lead edge of the sheet with said deflector urging the sheet back onto the conveyor, d. selectively deflecting the lead edge of the sheet in the direction the conveyor moves at about the place the sheet is urged back onto the conveyor, e. selectively deflecting the lead edge of the sheet in the direction opposite the direction the conveyor moves at about the place the sheet is urged back onto the conveyor to invert the sheet on the conveyor and f. selecting the deflection of the leading edge of the sheet relative to the conveyor depending upon whether inversion of the sheet is desired.

24. The method of claim 23 including the steps of:

arcuately deforming the sheet on the conveyor adjacent said deflector.

25. The method of claim 24 including the step of:

urging the sheet with the deflector back onto the conveyor after the arcuate deforming of the sheet by the conveyor.

26. The method of claim 24 including the step of:

arcuately deforming the sheet on the conveyor in one direction and subsequently arcuately deforming the sheet in the same direction on the deflector.

* * * * *